United States Patent [19]

Soeters, Jr.

[11] Patent Number: 4,638,570

[45] Date of Patent: Jan. 27, 1987

[54] SUPERCHARGER ASSEMBLY AND ROTOR PHASING FIXTURE AND METHOD OF PARTIALLY ASSEMBLING

[75] Inventor: Raymond A. Soeters, Jr., West Bloomfield Twonship, Oakland County, Mich.

[73] Assignee: Eaton Corporation, Cleveland, Ohio

[21] Appl. No.: 775,556

[22] Filed: Sep. 13, 1985

Related U.S. Application Data

[63] Continuation of Ser. No. 506,075, Jun. 20, 1983, abandoned.

[51] Int. Cl.[4] ..... G01B 5/14

[52] U.S. Cl. ..... 33/562; 33/181 AT

[58] Field of Search ..... 33/562, 180 AT, 181 AT, 33/180 R, 181 R, 435

[56] References Cited

U.S. PATENT DOCUMENTS 1,395,200 10/1921 Moore ..... 33/435

3,345,751 10/1967 Barzee, et al. ..... 33/435

*Primary Examiner*—William D. Martin, Jr.

*Attorney, Agent, or Firm*—D. A. Rowe; P. S. Rulon

[57] ABSTRACT

An improved Roots-type blower (10) and fixture (200) for timing rotors (20, 22) and timing gears (36, 38) of the blower during assembly. The blower includes a housing (12) defining generally cylindrical chambers containing the rotors having meshed, helical lobes (20*c*, 22*c*). The rotors are fixed to stepped diameter shafts (24, 26) pressed into stepped bores (20*d*, 22*d*) in the rotors. Straight splines on the shafts respectively form mating splines in the rotor bores and in the hub bore of timing gear (36). In a modified form of the blower, the straight splines form matting splines in both timing gears. The shafts are supported in the housing by fixed ball bearings (28, 30) at one end of the rotors and at the other end by ball bearing (32, 34) resiliently biased by springs which preload all four bearings. The fixture includes a base (202) having two surfaces (202*f*, 240*a*) for supporting ends (20*b*, 22*b*) of the rotors. Surface (202*f*) is integral with the base and surface (240*a*) is rotatable relative to surface (202*f*). The surfaces transversely space the shafts and rotors the same parallel distance apart they will have after final assembly of the blower and provide support of pressing the gears on the shafts. An annular gear (246), fixed to surface (240*a*) and having the same pitch diameter of rotor lobes ( 20*c*, 22*c*), drives a rack gear (260) which in turn drives a dial indicator (282) providing a direct readout of backlash between the lobe in response to rotation of surface (240*a*). Springs (268, 272) resiliently bias the rack gear into the annular gear to remove backlash.

31 Claims, 6 Drawing Figures

SUPERCHARGER ASSEMBLY AND ROTOR PHASING FIXTURE AND METHOD OF PARTIALLY ASSEMBLING

This is a continuation, of application Ser. No. 506,075, filed June 20, 1983, now abandoned.

CROSS-REFERENCE TO RELATED APPLICATIONS

This application is related to U.S. patent application Ser. Nos. 506,073 and 506,074, both filed June 20, 1983, both assigned to the assignee of this application, and both incorporated herein by reference.

BACKGROUND OF THE INVENTION

This invention relates to rotary compressors or blowers, particularly to blowers of the Roots-type. More specifically, the present invention relates to a method of assembling such blowers and to a fixture for timing the rotors and gears of such a blower.

Rotary blowers, particularly Roots-type blowers employed as superchargers for internal combustion engines are well-known in the prior art. However, they have not been widely used, particularly in passenger cars for several reasons since they, in general, have been characterized by several problems such as noisy operation, relatively high manufacturing and assembly costs, low efficiency and/or poor durability. Quite often, all or many of these problems are related to the basic design of a few components in such blowers since these basic designs often dictate machining costs and/or assembly methods which in turn may lead to one or more other problems such as noise, efficiency, and/or durability.

For example, during assembly of prior art rotary blowers, considerable time and effort are required to properly locate the rotors within the blower housing and to properly locate or time the meshed lobes of the rotors with respect to each other. Such meticulous locating and timing are necessary due to the fact that the rotors should have a very slight running clearance with the blower housing surfaces and likewise the meshed lobes of the rotors should have a very slight running clearance therebetween. Contact with the blower housing or between the meshed gears soon causes the blower to lose efficiency and/or fail. In the prior art, the rotors and their associated shafts and timing gears were either premachined to provide such locating and timing or were machined during assembly to provide such locating and timing. Both of these machining practices had to be extremely accurate, were naturally very expensive, were not conducive to fast and inexpensive assembly as required in a mass-production environment.

Herein is disclosed a rotary blower or supercharger designed to negate or substantially reduce all of the above-stated problems. For example, the rotors, shafts, and timing gears of the supercharger disclosed herein require no premachining or machining during assembly to effect proper timing. Further, the shafts may be pressed into the rotors without concern of phase relation or timing. Still further, the supercharger may be partially assembled and one of the timing gears installed without concern of phase relation or timing. Additionally, the supercharger disclosed herein is designed to be accurately and quickly timed during assembly by a specially designed fixture.

SUMMARY OF THE INVENTION

An object of this invention is to provide a fixture for accurately and quickly timing the rotors in rotary supercharger.

A more specific object of this invention is to provide such a fixture specially designed for a rotary supercharger designed for accurate and fast assembly in a mass-production environment.

The fixture or machine is operative during assembly of a rotary blower to time meshed, noncontacting lobes of first and second rotors respectively fixed to first and second parallel shafts transversely spaced a predetermined distance apart and driven in a fixed angular relation by first and second meshed timing gears respectively fixed to portions of the shafts extending axially beyond adjacent end faces of the rotors while the shafts at the adjacent end faces are supported in bearing assemblies carried by a portion of the blower housing and prior to meshing installation of the second gear with the first gear.

According to a feature of the invention, the fixture or machine includes a base having first and second surfaces disposed in a common plane for supporting the other adjacent end faces of the rotors thereon against rotation relative to their respective supporting surface and about their axis and with the axes of the shafts spaced the mentioned predetermined distance apart, one of the surfaces defined by a member mounted for rotation relative to the other surface and about the axis of the associated rotor shaft to allow setting a predetermined clearance between the meshed lobes; and a lock for preventing relative rotation between the surfaces after setting the clearance to facilitate positioning and fixing the second gear on the second shaft in meshing engagement with the first gear.

According to another feature of the invention, the machine includes an indicator providing a readout of the clearance between the lobes in response to rotation of the member.

According to another feature of the invention, a pinion gear is fixed to the member and is operative to move a rack gear connected to the indicator.

According to another feature of the invention, meshed gear teeth of the pinion and rack gears are resiliently biased into a zero backlash position.

BRIEF DESCRIPTION OF THE DRAWINGS

A Roots-type blower and a phasing and assembly fixture are shown in the accompanying drawings in which:

FIG. 3 is an enlarged, fragmentary view of a rotor assembly in FIG. 1;

FIG. 6 is a side elevational view of the supercharger and fixture in section.

Certain terminology referring to specific types of components, direction, motion, and the relationship of components to each other will be used in the following description. This terminology is for convenience in describing the invention and its environment and should not be considered limiting unless explicitly used in the appended claims.

DETAILED DESCRIPTION OF THE DRAWINGS

Figure 1:
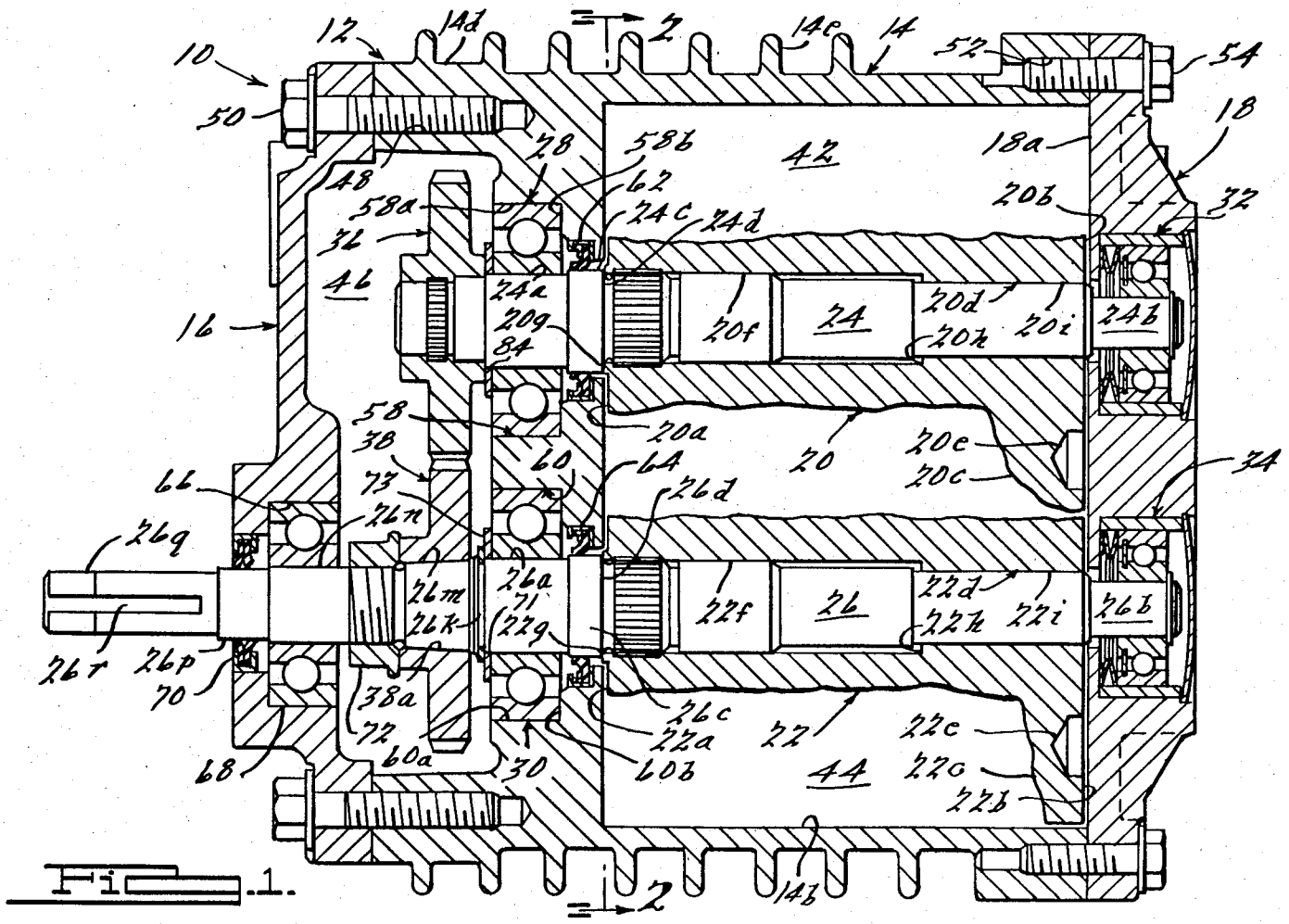
FIG. 1 is a cross-sectional view of the blower looking along line 1—1 of FIG. 2 with the rotor shafts of the blower in relief and with only a fragmental portion of the rotors shown.

FIG. 1 illustrates a Roots-type blower or compressor 10 including a housing assembly 12 having a main or center housing section 14 and end sections 16, 18, a pair of rotors 20, 22 mounted on parallel shafts 24, 26 to define rotor assemblies, bearing assemblies 28, 30 disposed at adjacent end faces 20*a*, 22*a* of the rotors, bearing assemblies 32, 34 disposed at the other adjacent end faces 20*b*, 22*b* of the rotors, and timing gears 36, 38 secured to the shafts 24, 26. Shaft 24 and gear 36 are driven elements and shaft 26 and gear 38 are drive or driving elements with respect to the driven elements. Bearings 28–34 are by definition antifriction bearings, i.e., rolling contact bearings.

Figure 2:
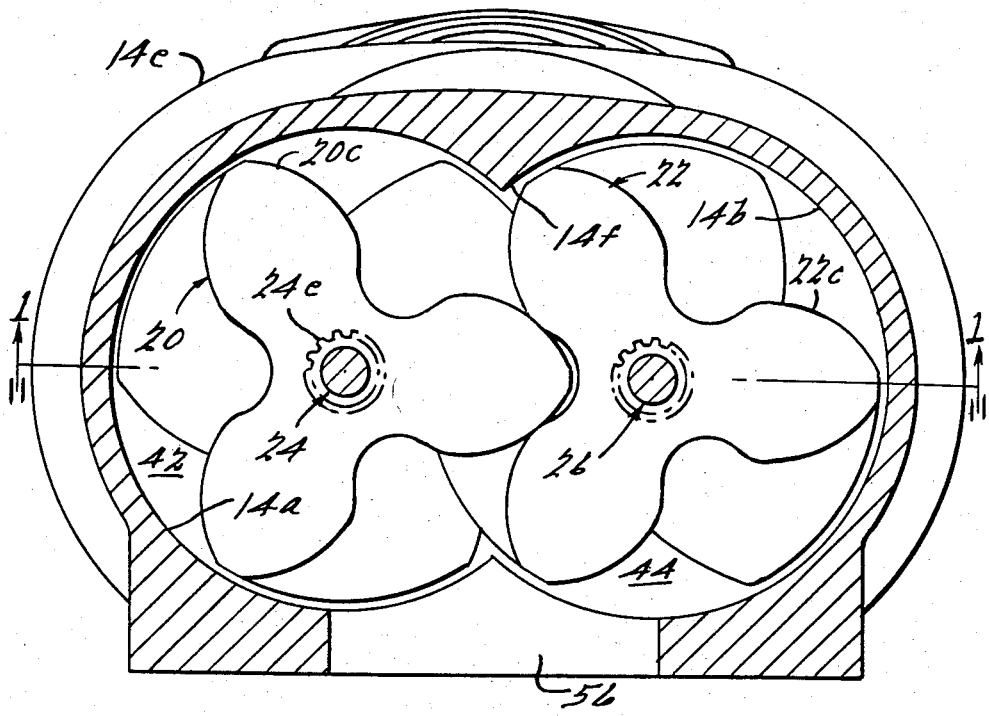
FIG. 2 is a cross-sectional view of the blower looking along line 2—2 of FIG. 1.

Housing assembly 10 is preferably a lightweight material such as aluminum. The assembly includes or defines a pair of generally cylindrical working chambers 42, 44 defined circumferentially by cylindrical wall portions 14*a*, 14*b* and end wall portions 14*c*, 18*a* defining end surfaces normal to the cylindrical wall portions. The chambers transversely overlap each other and the end walls of both chambers are disposed in common planes. The housing assembly further includes a chamber 46 separated from chambers 42, 44 by end wall portion 14*c*, an annular axially extending side wall portion 14*d* having a plurality of threaded bores 48 for securing end section 16 thereto by bolts 50, a plurality of threaded bores 52 for securing end section 18 to the other end of the housing by bolts 54, a plurality of cooling and reinforcing ribs 14*e*, an outlet or discharge port 56 seen only in FIG. 2, and an unshown inlet or suction port. The inlet port has its entrance defined by end section 18; the port extends axially into chambers 42, 44 with a decreasing cross-sectional area that terminates just short of a cusp 14*f* defined by the intersection of cylindrical wall portions 14*a*, 14*b* as seen in FIG. 2. End wall portion 14*c* includes through bores 58, 60 having major diameters 58*a*, 60*a* and shoulders 58*b*, 60*b* for supporting and positioning bearing assemblies 28, 30 in the housing; intermediate diameters provide support for radial seals 62, 64.

End section 16 includes a bore 66 having a ball or antifriction bearing 68 disposed therein for supporting the drive end of driving shaft 26 and a seal 70 for sealing chamber 46 from the ambient or the exterior of the housing assembly. Chamber 46 contains oil for lubricating ball bearings 28, 30, 68 and gears 36, 38.

Rotors 20, 22 are preferably formed of a lightweight material such as aluminum. The rotors are shown fragmentally in FIG. 1. Each rotor includes three helical teeth or lobes 20*c*, 22*c* of modified involute profile, as shown in FIG. 2, an axially extending bore 20*d*, 22*d* having an axis concentric to the lobes, and alignment or phasing holes 20*e*, 22*e* extending axially into end faces 20*b*, 22*b* of each lobe. The lobes pump or transport a fluid, such as air, from the housing inlet to the housing outlet. The bores are identical and each includes, as viewed from left-to-right in FIG. 1, a first diameter bore portion 20*f*, 22*f* extending from a shoulder defined by the end face of a small hub portion 20*g*, 22*g* projecting axially from end face 20*a*, 22*a* to a shoulder 20*h*, 22*h* defined by the difference in diameter between the first bore portion and a second bore portion 20*i*, 22*i* of reduced diameter. The cylindrical walls of the first and second bore portions are machined smooth and the axial distances between the end faces of hub portions 20*g*, 22*g* and shoulders 20*h* 22*h* are closely controlled-for reasons discussed hereinafter. Rotors 20, 22 are disclosed herein in FIG. 2 with three circumferentially disposed lobes extending helically about the axis of their respective shafts or bores and with modified involute profiles. However, other well-known rotor forms may be employed, such as two-lobe with or without involute lobes, straight lobes extending parallel to the rotor axis, etc.

The outer circumferential extent of the rotors (i.e., the top lands of the lobes) and end faces 20*a*, 22*a*, 20*b*, 22*b* should never touch the cylindrical and end surfaces defining chambers 42, 44, nor should the meshing profiles of the lobes ever touch each other. However, to minimize internal leakage, any clearance provided to prevent such touching should be held to an absolute minimum. This minimum clearance is determined by several factors, such as, machining tolerances of individual parts, stack-up tolerances during assembly, backlash in the timing gears 36, 38, radial and axial growth of parts relative to each other due mainly to nonuniform temperature changes and differences in coefficient of expansion of parts, and radial and axial bearing play.

Looking now at FIGS. 1–3, driven shaft 24 and driving shaft 26 respectively include bosses 24*a*, 4*b* and 26*a*, 26*b* for rotationally supporting the rotor and shaft assemblies in bearing assemblies 28–34. Shafts 24, 26 are identical between these bosses. Hence, a description of portions of shaft 24 between bosses 24*a*, 24*b* will suffice for both shafts and will require further detailed description only with respect to shaft portions to the left of bosses 24*a*, 26*a* for both shafts as viewed in FIG. 1. Portion of shaft 26 between bosses 26*a*, 26*b* are not given reference characters to avoid undue clutter of the drawings.

Looking now mainly at FIG. 3, shaft 24 includes a boss 24*c* having radial seal 62 running thereon, a shoulder 24*d* which abuts the end face of hub portion 20*g* to define the axial position of the shaft in the rotor bore, a rolled spline portion 24*e*, and smooth surface portions 24*f*, 24*g* which respectively form interference fits with bore portions 20*f*, 20*i* when shaft is pressed into place. Shoulder 24*d* ensures that growth difference between the shaft and rotor are to the right of the shoulder or are a minimum at the splines. Smooth surface portions 24*f*, 24*g* are axially separated by a shaft portion 24*h* and a conical or chamfered portion 24*i*. The right end of smooth surface portion 24*g* also includes a conical or chamfered portion 24*j*. Shaft 24 is preferably formed from steel. Splines 24*e* extend parallel to the axis of shaft 24 and function similar to a broach when shaft 24 is pressed into bore 20, i.e., splines 24*e* form mating splines in the bore. The self-broaching function of splines 24*e* may be improved by application of a hardening process to the splines.

The left end of shaft 24 is similar to the portions of the shaft between seal boss 24*c* and bearing boss 24*b*, i.e., the left end includes smooth surface portions 24*k*, 24*m* which form interference fits with stepped bore portions 36*a*, 36*b* in gear 36 and a rolled spline portion 24*n* having axially extending splines Which function similar to a broach when gear 36 is pressed on the shaft. Gear 36 is preferably of variable hardness, i.e., the tooth portion of the gear is hardened and the hub portion is relatively soft to allow the self-broaching by the shaft splines 24*n*.

Alternatively, gear 36 may be of uniform hardness and have internal splines in which case the steps at the shaft end would be smooth and relatively soft.

The left end of shaft 26, as shown in FIG. 1, includes an annular recess 26*k* having a snap ring 71 disposed therein for positioning a shim 73, a tapered or conical portion 26*m* for receiving a mating conical bore 38*a* in gear 38, a threaded portion having a nut 72 threaded thereon for securing or seating the gear on the tapered portion, a boss 26*n* having the inner race of bearing 68 lightly pressed thereon, a boss 26*p* having radial seal 70 running thereon, and a drive end 26*q* having a key slot 26*r* for keying a V-pulley or the like to the shaft.

Figure 4:
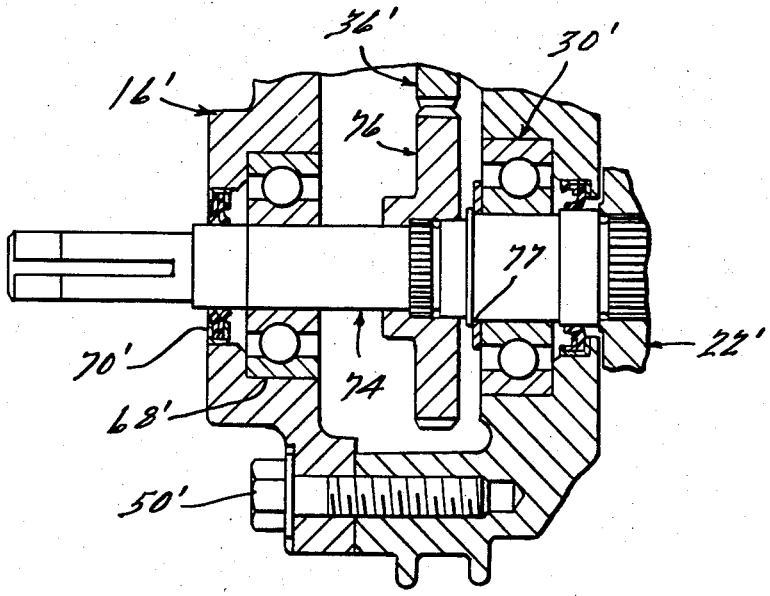
FIG. 4 is a modified form of a portion in FIG. 1.
Figure 2:
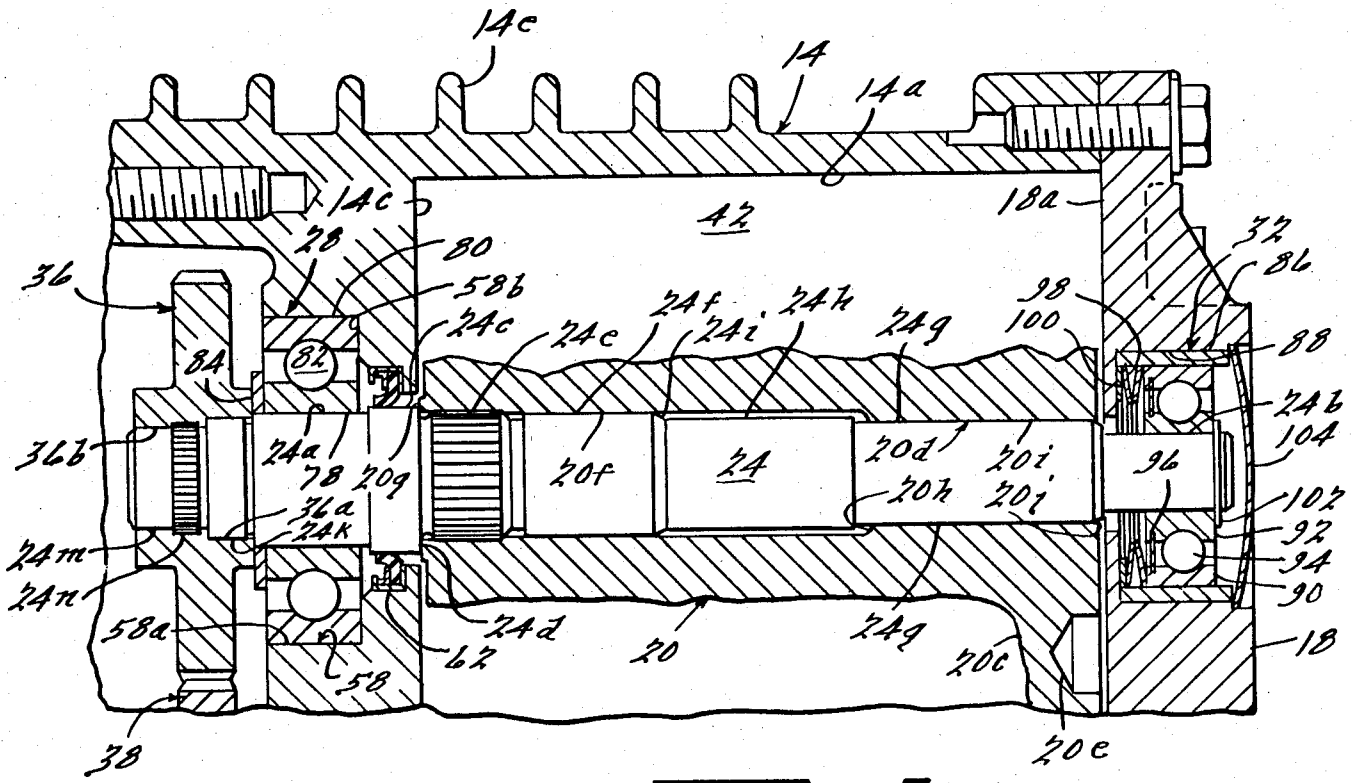

Looking briefly at the modified form shown in FIG. 4, therein all parts, elements, and portions of the supercharger which are identical to corresponding parts, elements, and portions of the supercharger in FIGS. 1–3 are given the same reference characters with a prime added. The modified form includes a shaft 74 and a gear 76 which respectively replace shaft 26 and gear 38. Shaft 74 and gear 76 are configured to be joined together in the same manner as shaft 24 and gear 36, all other parts of 74 and gear 76 are the same as described for shaft 26 and gear 38.

Looking again at FIGS. 1–3, bearing assemblies 28, 30 are identical as are bearing assemblies 32, 34. Hence, a detailed description of bearing assemblies 28, 32 will suffice for both rotor and shaft assemblies. Ball-bearing assembly 28 includes inner and outer races 78, 80 and a plurality of balls or rolling contact means 82 which interconnect the races with a limited amount of radial and axial bearing play between the races. The outer race is snugly pressed into the major diameter portion 58*a* of bore 58 and seated against shoulder 58*b* which fixes the axial position of the bearing assembly with respect to end wall portion 14*c* of chamber 42. The inner race is snugly pressed on boss 24*a* and is axially positioned on the boss by an annular shim 84 whose thickness is determined during assembly of the supercharger as explained hereinafter.

Bearing assembly 32 includes a steel or wear resistant sleeve 86 snugly pressed into a stepped bore 88 in end section 18, outer and inner races 90, 92, a plurality of balls or rolling contact means 94, a seal 96, a spring assembly 98 having two Belleville or cone-disk springs reacting between outer race 90 and a steel washer 100, a snap ring 102, and a cap or plug 104 for sealing the bearing from the ambient or the exterior of the housing assemby and thereby defining in combination with seal 96 a cavity containing a lubricant such as grease. Outer race 90 forms a close tolerance, sliding fit with steel sleeve 86 and the inner race forms a snug press fit with boss 24*b*. Steel sleeve 86 prevents fretting of the aluminum structure of end section 18. Spring assembly 98 biases shaft 24 and rotor 20 to the right and hence biases inner race 92 and shaft 24 to the right. Snap ring 102 ensures retention of the inner race on boss 24*b*. Balls 94 of bearings 32, 34, like balls 82 of bearings 28, 30, interconnect the outer and inner races with a limited amount of radial and axial bearing play therebetween. Inner race 92 is preferably pressed on boss 24*b*; alternatively the inner race may form a close tolerance sliding fit with boss 24*b*, in which case snap ring 102 then prevents axial movement of the race in one direction.

In general, bearings designed to react radial and axial forces, such as ball bearings 28 and 32, are manufactured such that the balls interconnect their outer and inner races with limited amounts of radial and axial bearing play therebetween. Some of the bearing play is intentionally built into the bearing during manufacture to allow for shrinkage of the outer race when it is pressed into a bore, expansion of the inner race when it is pressed on a shaft, and thermal growth when the bearing reaches operating temperature during use. Additionally, some of the bearing play is due to manufacturing tolerances of the bearing and some is due to manufacturing tolerances of the bores and shafts that receive the races. These manufacturing tolerances may vary over a rather wide range and, in general, decrease with increasing manufacturing costs. In a Roots blower wherein the bearings are subjected to fluctuating loads, the tolerance affects bearing noise, bearing life, and the running clearances between the rotors and blower housing and between the meshed lobes of the rotors.

With the above-described bearing arrangement, the rotor and shaft assemblies are readily positioned with respect to each other and with respect to their cylindrical and end wall surfaces without meticulous adjustments during assembly even when axial and radial play in the ball bearing assemblies varies over rather wide ranges. Further, the bearing play is effectively reduced to zero without fear of bearing overload, thereby reducing bearing noise, improving bearing life, and facilitating the use of minimum running clearances between the meshed lobes of the rotors and the housing surfaces defining chambers 42, 44. To further improve the minimum running clearance between the meshed lobes of the rotors and the housing surfaces, the rotors and/or the housing surfaces may be coated with an abradable graphite material such as 2ES which is obtainable from Superior Graphite Company, 20 North Wacker Drive, Chicago, IL 60606. The material, which may be sprayed on, readily wears or abrades in response to contact with relatively moveable surfaces until substantially zero clearance exists therebetween.

Supercharger 10 is designed to be readily and accurately assembled in mass production. The rotors and their associated shafts are assembled first. Since the aluminum of the rotors has a greater coefficient of expansion than the steel of the shafts, the amount of interference fit between the smooth surface shaft portions and their associated bore portions is calculated to ensure an interference fit when the rotors are operating at their maximum design temperature. To prevent metal deformation such as galling of the rotor bores and bending of the shafts while the shafts are being pressed into the bores, the rotors are preheated to their maximum calculated design temperature. When the shafts are first placed into their respective bores, they freely enter until their chamfered portions seat against the shoulders defined by the hub portions 20*g*, 22*g* and portions 20*h*, 22*h* defined by the difference in diameter of the bore portions. The axially spaced apart chamfers ensure axial alignment of the shafts in the bores as the shafts are pressed into the bores. The broach shaped splines on the shafts cut mating splines in the smoothly machined surfaces of the bore portions 20*f*, 22*f*. This self-broaching feature reduces machining costs of the rotors, since the relatively expensive process of forming internal splines or keyways in a small diameter bore is avoided, reduces assembly costs since the shafts may be pressed into the rotor bores without concern of angular phasing or timing between the shafts and their associated rotors as is necessary when both the shafts and rotor bores have previously machined splines or keyways, and the self-broaching ensures substantially perfect concentricity between the shaft and rotor axes since any lack of concentricity of the self-broaching splines and the shaft axis will not effect shaft-rotor concentricity.

Figure 5:
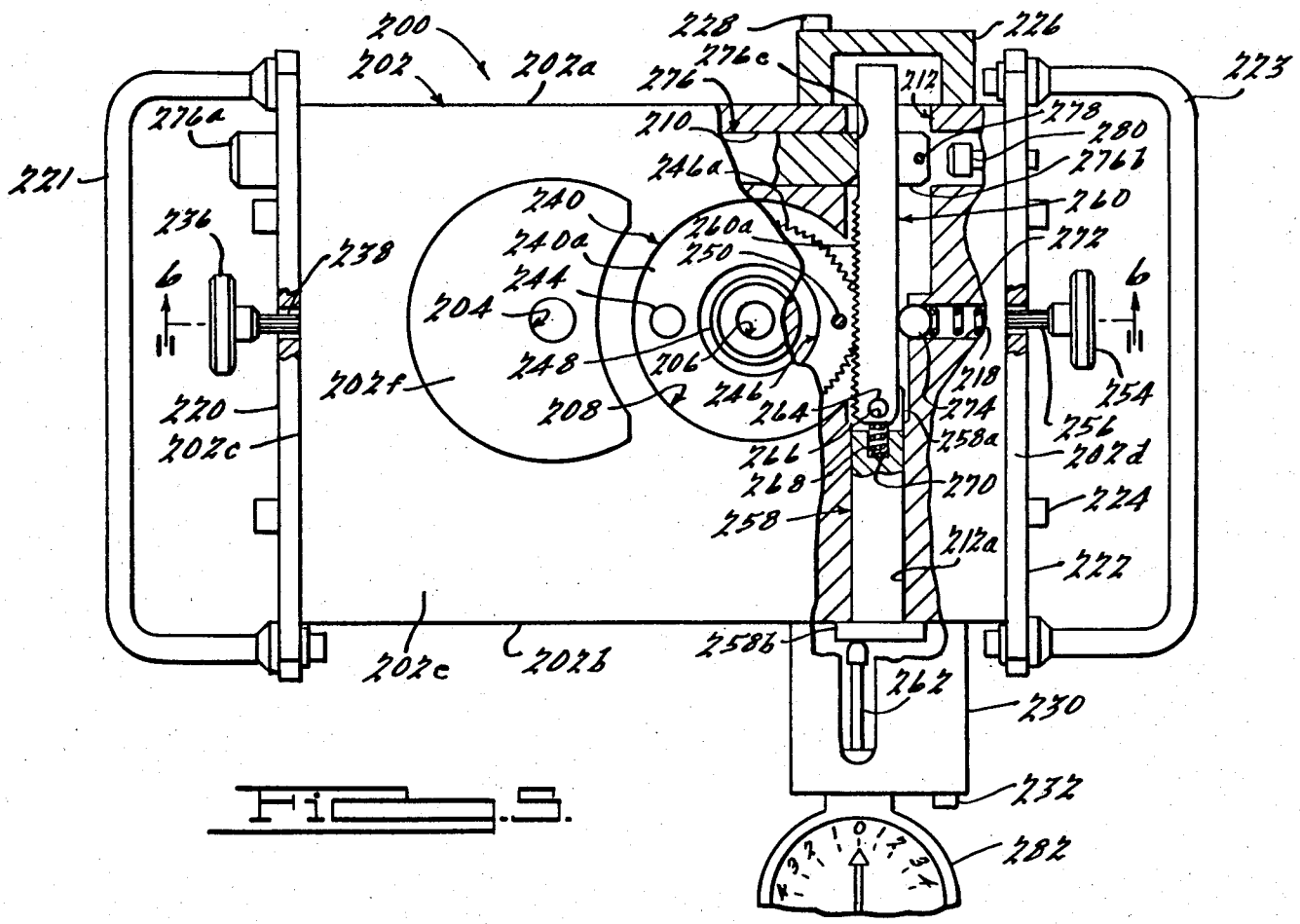
FIG. 5 is a plan view of the fixture with broken away portions in section.
Figure 5:
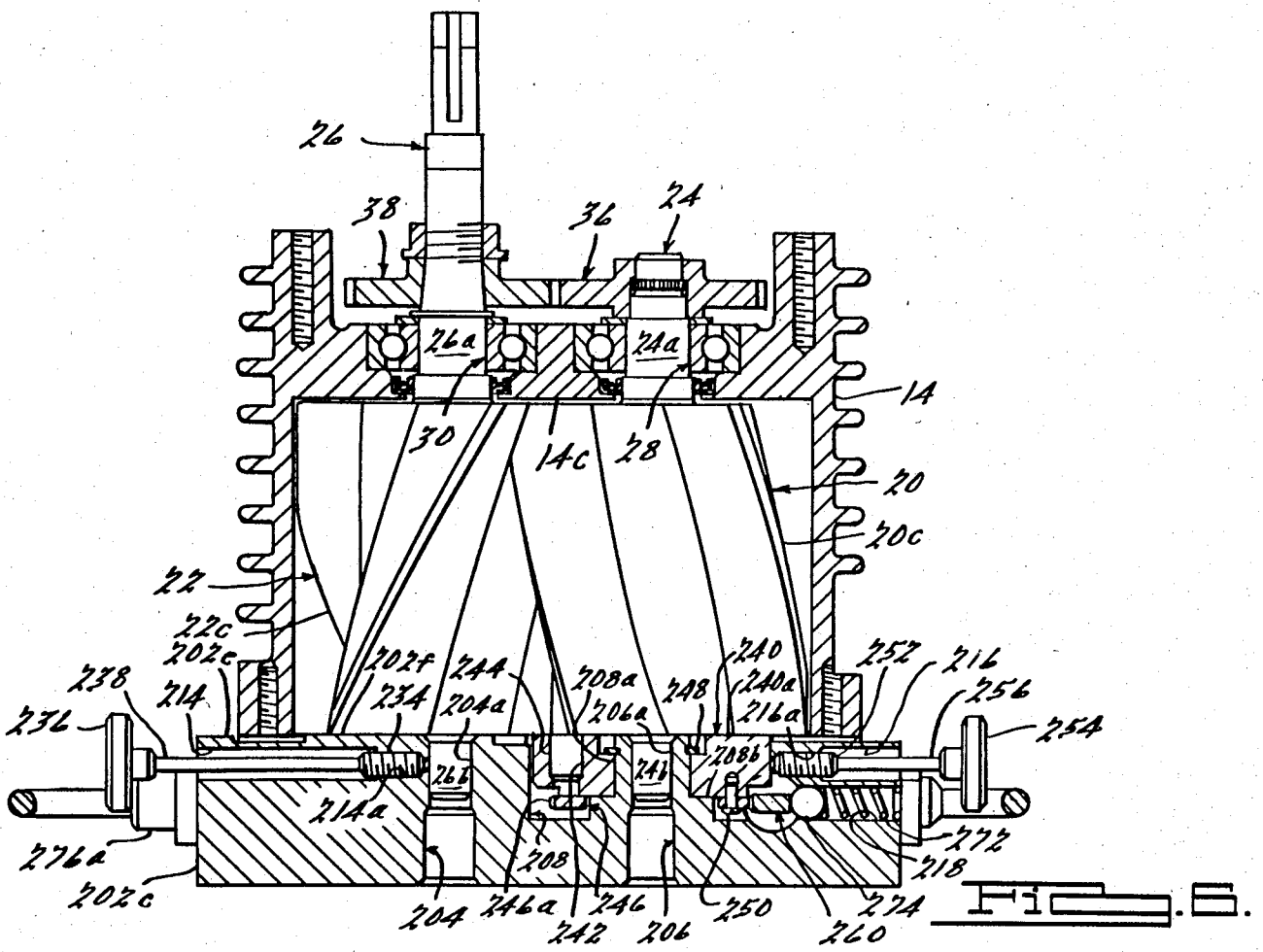

The shaft-rotor assemblies are then placed on a phasing and assembly fixture or machine 200 illustrated in FIGS. 5 and 6 to facilitate positioning the rotors in housing 14 and installation of bearings 28, 30. This part of the assembly may be accomplished prior to use of fixture 200. The fixture includes a rectangular base 202 having longitudinally extending sides 202*a*, 202*b*, transversely extending ends 202*c*, 202*d*, a flat upper surface 202*e*, a first raised surface 202*f* of somewhat crescent shape, first and second stepped through bores 204, 206, a stepped annular recess 208, a through bore 210 extending longitudinally between ends 202*c*, 202*d*, a stepped bore 212 extending transversely between sides 202*a*, 202*b* and intersecting recess 208 and bore 210, a stepped bore 214 extending between end 202*c* and stepped bore 204, a stepped bore 216 extending between end 202*d* and stepped recess 208 and a bore 218 extending between end 202*d* and bore 212. End plates 220, 222 are fixed to the base by a plurality of bolts 224. The fixture may be moved about by handle 221, 223 fixed to the end plates. Bores 210, 218 are closed at end 202*d* by end plate 222. Bore 212 is closed at side 202*a* by a cover 226 fixed to the base by a plurality of cap screws 228 and is closed at side 202*b* by a dial indicator mount 230 fixed to the base by a plurality of cap screws 232.

Stepped bore 204 includes a reduced diameter portion 204*a* machined to close tolerance for sliding receipt of boss 26*b* of supercharger shaft 26. Bore 214 includes a portion 214*a* threadably receiving a lock screw 234 fixed to a knob 236 via a shaft 238 for selectively locking shaft 26 and rotor 22 against rotation relative to surface 202*f*.

Stepped annular recess 208 includes an inner wall surface or hub 208*a* and a shoulder or support surface 208*b* both machined to close tolerance for radially and vertically positioning an annular member 240 in the recess for close tolerance rotation about the axis of bore 206. Annular member 240 includes an upper surface portion 240*a* disposed in a plane common to the plane of surface 202*f*, a stepped through bore 242 having a dowel 244 pressed therein and projecting upward beyond surface 240*a* for forming a close tolerance sliding fit with one of the phasing holes 20*e* in rotor 20, and an annular gear or pinion 246 having external spur gear teeth 246*a* with a pitch diameter or circle equal to the pitch diameter or circle of lobes 20*c* of rotor 20. A snap ring 248 retains the annular member in recess 208 and a plurality of screws 250 fixing the pinion to the annular member with the pitch circle concentric with the axis of bore 206. Bore 206 includes a reduced diameter portion 206*a* machined to close tolerance for receiving boss 24*a* of rotor shaft 24. The transverse spacing of bore portions 204*a*, 206*a* is the same as the transverse spacing of bores 58, 60 in end wall portion 14*c* of the supercharger housing 14. Accordingly, when the partially assembled supercharger is placed on fixture 200, as shown in FIG. 6, the axes of shafts 24, 26 assume the same parallel relation to each other they will have after final assembly of the supercharger. Bore 216 includes a portion 216*a* threadably receiving a lock screw 252 fixed to a knob 254 via a shaft 256 for selectively locking annular member 240 against rotation in recess 208 and accordingly preventing rotation of shaft 24 and rotor 20.

Stepped bore 212 includes a bore portion 212*a* forming a close tolerance sliding fit with a member 258 having a bifurcated end 258*a* slidably receiving one end of a rack gear 260 having teeth 260*a* in mesh with pinion teeth 246*a*. End 258*a* is partially sectioned and shows only the bottom tine projecting beyond the rack. The other end of member 258 includes an annular flange or head 258*b* which limits movement of the member into the bore and which contacts a dial indicator link 262. Rack gear 260 is loosely connected to member 258 by a pin 264 pressed into transverse bores in the tines at the bifurcated end. The pin is loosely received in or extends through a bore 266 in the rack end. The rack is biased in its longitudinal direction by a spring 268 seated at one end in a recess 270 in member 258 and pushing at the other end against rack 260. The rack is biased in its transverse direction by a spring 272 disposed in bore 218 and reacting at one end against end plate 222 and at the other end against a ball 274 slidably disposed the bore. Springs 268 and 272 resiliently remove all back lash in one direction between the meshed teeth of pinion 246 and rack 260.

Bore 210 forms a rather close tolerance sliding fit with a release rod 276 having at one end a buttonlike portion 276*a* extending through end plate 220 and at the other end a bifurcated portion transversely extending across bore 212. The bifurcated end is partially sectioned to show the bottom tine 276*b* which slidably supports the adjacent end of rack 260. A rounded abutment 276*c* contacts the rack and a pin 278, pressed into a transverse bore in the tines maintains rod 276 in bore 210. A bolt 280, threaded into end plate 222, limits travel of the rod.

A partially shown dial indicator 282 of conventional construction is positioned on mount 230 and is actuated by link 262 in response to longitudinal movement of rack 260.

When fixture 200 is used to facilitate positioning the rotor assemblies in housing 14 and for installation of bearings 28, 30, bosses 24*b*, 26*b* are placed in bores 208, 206 to orient the axes of the rotor assemblies with respect to each other. Center housing section 14, with seals 62, 64 pressed into bores 58, 60, is then placed on the assemblies with removeable shims positioned between end faces 20*a*, 22*b* and end wall 14*c*. Bearings 28, 30 are then pressed into position with the outer races seated against shoulders 58*b*, 60*b* and the inner races axially positioned on bosses 24*a*, 26*a* such that any bearing play between the races and the balls is taken up in the direction of the bearing assemblies 32, 34. The axial distance between the faces of the inner races and the shoulders defined by the left end of bosses 24*a*, 26*a* are filled by appropriately sized shims 84, 73 which are respectively retained by pressing gear 36 on shaft 24 and by inserting snap ring 71. This part of the assembly may be accomplished prior to positioning shaft bosses 24*b*, 26*b* in fixture 200.

Backlash or clearance between the meshed lobes of rotors 20, 22 is then determined using the following procedure. Rotor 22 is locked or fixed against rotation relative to surface 202*f* by lock screw 234 and rotor 20 is turned through the total clearance between the then meshed lobes. The clearance is shown on dial indicator 282. Rotor 22 is then unlocked, button 276 is depressed to release rack 260 and disengage the dial indicator from gear 246, and rotors 20, 22 are rotated to new positions to determine the clearance between a different set of meshed lobes to find the set of meshed lobes having the minimum backlash or clearance. The clearance between the set of lobes having the minimum clearance is then set to provide a minimum backlash in each direction. Rotor 20 is then locked or fixed against rotation relative to rotor 22 by lock screw 252. Timing gear 38 is then loosely positioned on tapered portion 26*m* of shaft 26 and meshed with gear 36 to effect proper timing therebetween. An axial force is applied to seat gear 38 on the tapered surface and gear 38 is then locked on the tapered surface by threading nut 72 into abutment with the gear. In the modified form of FIG. 4, gear 76 freely telescopes on shaft 74 far enough to allow meshing engagement with gear 36; the adjusted backlash is locked by pressing gear 76 on shaft 74 in a manner analogous to pressing gear 36 on shaft 24.

The partially assembled supercharger is then removed from the fixture to allow installation of end section 18 and bearing assemblies 32, 34. The springs in the bearing assemblies preload the rotor and shaft assembly to the right, as viewed in FIG. 1, thereby removing all axial and radial bearing play and allowing the rotors and shafts to thermally expand or contract axially due to temperature changes. The axial expansion and contraction will always occur relative to bearing assemblies 28, 30 since their inner and outer races are respectively fixed relative to the shafts and housing and since the spring assemblies always bias the shaft and rotor assemblies to the right. Further, the axial expansions and contractions will not appreciably change preload of the bearings since the spring assemblies maintain the preload substantially constant. End section 16 with seal 70 and bearing 68 positioned in bore 66 may then be attached to center housing section 14 via bolts 50.

Two embodiments of a supercharger and one of a phasing and assembly fixture have been disclosed for illustrative purposes. Many variations and modifications of the disclosed embodiments are believed to be within the spirit of the invention. The following claims are intended to cover inventive portions of the disclosed embodiments and variations and modifications believed to be within the spirit of the inventive portions.

What is claimed is:

1. A machine operative to time meshed, lobed rotors of a partially assembled rotary blower, the blower during assembly and machine in combination comprising:

a housing section; first and second meshed, lobed rotors having first and second pairs of adjacent end faces at their opposite ends; first and second shaft portions respectively fixed to the first and second rotors and extending axially beyond the first pair of adjacent end faces; bearing assemblies carried by the housing section and supporting the shaft portions a predetermined transverse distance apart; a first timing gear fixed to one of said shaft portions; and a second timing gear adapted to be fixed to the other shaft portion and meshed with the first timing gear for establishing a fixed angular relation between the rotors; and a base having first and second surfaces disposed in a common plane for supporting the second pair of adjacent end faces of the rotors thereon against rotation relative to their respective supporting surfaces about the shaft axes and with shaft axes spaced a predetermined distance apart, one of said surfaces defined by a member mounted for rotation relative to the other surface and about the axis of the associated rotor shaft to allow setting a predetermined clearance between the meshed lobes prior to fixing the second timing gear to the other shaft.

2. The machine of claim 1, further including:

means for preventing said relative rotation between the surfaces after setting said clearance to facilitate positioning and fixing the second gear on the second shaft in meshing engagement with the first gear.

3. The machine of claim 1, further including:

readout means for indicating the total amount of clearance between the meshed lobes in response to rotation of said one surface.

4. The machine of claim 3, wherein said readout means includes:

means moveable with and fixed to said member and in axial alignment with a point on the pitch circle of the lobes of the rotor supported on said one surface; and means operative in response to movement of said means moveable to provide a direct indication of the clearance between the meshed lobes at the intersection of the pitch diameters of the lobes.

5. The machine of claim 1 further including:

a pinion gear fixed to said member and having external gear teeth with a pitch diameter substantially equal to the pitch diameter of the lobes of the rotor supported by said surface defined by said member and concentric to the rotational axis of said member;

a rack gear having teeth in mesh with the teeth of said pinion gear and slidably moveable in response to rotation of said member;

an indicator connected with said rack for recording a one-to-one indication of the clearance between said lobes.

6. The machine of claim 5, further including:

means for pivotally moving said rack gear out of mesh with said pinion gear to allow rotation of said member without slidably moving said rack gear.

7. The machine of claim 6, further including:

resilient means biasing said rack gear teeth into meshing engagement with said pinion gear teeth.

8. The machine of claim 7, wherein said resilient means includes:

means biasing said rack gear transverse to the direction of said sliding movement of said rack gear.

9. The machine of claim 8, wherein said resilient means further includes:

means biasing said rack gear in the direction of said sliding movement of said rack gear.

10. The machine of claim 9, further including:

means for preventing said relative rotation between the surfaces after setting said clearance to facilitate positioning and fixing the second gear on the second shaft in meshing engagement with the first gear.

11. A method of partially assembling a rotary blower and timing the partially assembled blower on a fixture having first and second surfaces deposed in a common plane with one of the surfaces mounted for rotation relative to the other; the blower including a housing, first and second lobed rotors having first and second end surfaces, first and second shaft portions, bearing assemblies carried by a housing section and transversely spaced a predetermined distance apart, and first and second timing gears; the method comprising:

fixing the first and second shaft portions, respectively, to the first and second rotors with the shaft portions extending beyond the first end surfaces and without regard to the angular phase relation between the axes of the shaft portions and the rotors;

supporting the shaft portions in the bearing assemblies with the rotor lobes in mesh;

fixing the first timing gear to one of said shaft portions;

supporting the second end surfaces on the fixture surfaces with their axes transversely spaced a predetermined distance apart;

preventing rotation of the rotors relative to their associated fixture surface;

setting a clearance between the meshed lobes; then, preventing rotation of the rotary mounted surface; and fixing the second timing gear to the other shaft and in mesh with the first gear.

12. A machine operative to time meshed, lobed rotors of a partially assembled rotory blower, the blower during assembly and the machine in combination comprising:

a housing section; first and second meshed, lobed rotors having first and second pairs of adjacent end faces at their opposite ends; first and second shaft portions respectively fixed to the first and second rotors and extending axially beyond the first pair of adjacent end faces; bearing assemblies carried by the housing section and supporting the shaft portions a predetermined transverse distance apart; first and second timing gears respectively adapted to be fixed to the first and second shaft portions and meshed with each other for establishing a fixed angular relation between the rotors; and a base having first and second surfaces disposed in a common plane for supporting the second pair of adjacent end faces of the rotors thereon against rotation relative to their respective supporting surfaces about the shaft axes and with shaft axes spaced a predetermined distance apart, one of said surfaces defined by a member mounted for rotation relative to the other surface and about the axis of the associated rotor shaft to allow setting a predetermined clearance between the meshed lobes prior to fixing the first and second timing gears to the shaft portions.

13. The machine of claim 12, further including:

means for preventing said relative rotation between the surfaces after setting said clearance to facilitate positioning and fixing the gears on the shaft portions in meshing engagement with each other.

14. The machine of claim 12, further including:

readout means for indicating the total amount of clearance between the meshed lobes in response to rotation of said one surface.

15. The machine of claim 14, wherein said readout means includes:

means moveable with and fixed to said member and in axial alignment with a point on the pitch circle of the lobes of the rotor supported on said one surface; and means operative in response to movement of said means moveable to provide a direct indication of the clearance between the meshed lobes at the intersection of the pitch diameters of the lobes.

16. The machine of claim 12, further including:

a pinion gear fixed to said member and having external gear teeth with a pitch diameter substantially equal to the pitch diameter of the lobes of the rotor supported by said surface defined by said member and concentric to the rotational axis of said member;

a rack gear having teeth in mesh with the teeth of said pinion gear and slidably moveable in response to rotation of said member;

an indicator connected with said rack for recording a one-to-one indication of the clearance between said lobes.

17. The machine of claim 16, further including:

means for pivotally moving said rack gear out of mesh with said pinion gear to allow rotation of said member without slidably moving said rack gear.

18. The machine of claim 17, further including:

resilient means biasing said rack gear teeth into meshing engagement with said pinion gear teeth.

19. The machine of claim 18, wherein said resilient means includes:

means biasing said rack gear transverse to the direction of said sliding movement of said rack gear.

20. The machine of claim 19, wherein said resilient means further includes:

means biasing said rack gear in the direction of said sliding movement of said rack gear.

21. The machine of claim 20, further including:

means for preventing said relative rotation between the surfaces after setting said clearance to facilitate positioning and fixing the gears on the shaft portions in meshing engagement with eath other.

22. A method of partially assembling a rotary blower and timing the partially assembled blower on a fixture having first and second surfaces deposed in a common plane with one of the suraces mounted for rotation relative to the other; the blower including a housing, first and second lobed rotors having first and second end surfaces, first and second shaft portions, bearing assemblies carried by a housing section and transversely spaced a predetermined distance apart, and first and second timing gears; the method comprising:

fixing the first and second shaft portions, respectively, to the first and second rotors with the shaft portions extending beyond the first end surfaces and without regard to the angular phase relation between the axes of the shaft portions and the rotors;

supporting the shaft portions in the bearing assemblies with the rotor lobes in mesh;

supporting the second end surfaces on the fixture surfaces with their axes transversely spaced a predetermined distance apart;

preventing rotation of the rotors relative to their associated fixture surface;

setting a clearance between the meshed lobes; then, preventing rotation of the rotary mounted surface; and fixing first and second timing gears respectively to the first and second shaft portions and in mesh with each other.

23. The method of claim 22, wherein said first timing gears including cylindrical bore surface means, said first shaft portion including cylindrical shaft surface means of greater diameter than the bore surface means, and a set of circumferentially space spline teeth formed in one of the surface means and of a material operative to deform a portion of the other surface means, and the method of fixing said first gear to said first shaft portion including:

pressing said first shaft portion partially into said bore surface means to effect at least a partial interference fit between said shaft and bore surface means; and pressing said first shaft portion further into said bore surface means to effect deformation of said other surface means by said spline teeth, thereby forming mating splines in said other surface means.

24. The method of claim 23, further including:

forming said spline teeth operative to deform on said shaft portion.

25. The method of claim 22, wherein said first and second timing gears each including cylindrical bore surface means, said first and second shaft portions each including cylindrical shaft surface means of greater diameter than the bore surface means, and a set of circumferentially spaced spline teeth formed in one of the surface means of either the gears or the shaft portions and of a material operative to deform a portion of the other surface means; the method of fixing said gears to said shaft portions including;

pressing said shaft portions partially and simultaneously into said bore surface means to effect at least a partial interference fit between said shaft and bore surface means; and pressing said shaft portions further and simultaneously into said bore surface means to effect deformation of said other surface means by said spline teeth, thereby forming mating splines in said other surface means.

26. The method of claim 25, further including:

forming said spline teeth operative to deform on said shaft portions.

27. A method of partially assembling a rotary blower and timing the partially assembled blower on a fixture having first and second surfaces deposed in a common plane; the blower including a housing, first and second lobed rotors having first and second end surfaces, first and second shaft portions, bearing assemblies carried by a housing section and transversely spaced a predetermined distance apart, and first and second timing gears; the method comprising:

fixing the first and second shaft portions, respectively, to the first and second rotors with the shaft portions extending beyond the first end surfaces and without regard to the angular phase relation between the axes of the shaft portions and the rotors;

supporting the shaft portions in the bearing assemblies with the rotor lobes in mesh;

supporting the second end surfaces on the fixture surfaces with their axes transversely spaced a predetermined distance apart;

setting a clearance between the meshed lobes; then, preventing rotation of the rotors relative to each other; and fixing the second timing gear to the other shaft and in mesh with the first gear.

28. The method of claim 27, wherein said first timing gears including cylindrical bore surface means, said first shaft portion including cylindrical shaft surface means of greater diameter than the bore surface means, and a set of circumferentially spaced spline teeth formed in one of the surface means and of a material operative to deform a portion of the other surface means, and the method of fixing said first gear to said first shaft portion including:

pressing said first shaft portion partially into said bore surface means to effect at least a partial interference fit between said shaft and bore surface means; and pressing said first shaft portion further into said bore surface means to effect deformation of said other surface means by said spline teeth, thereby forming mating splines in said other surface means.

29. The method of claim 28, further including:

forming said spline teeth operative to deform on said shaft portion.

30. The method of claim 27, wherein said first and second timing gears each including cylindrical cylindrical bore surface means, said first and second shaft portions each including cylinderical shaft surface means of greater diameter than the bore surface means, and a set of circumferentially spaced spline teeth formed in one of the surface means of either the gears or the sahft portions and of a material operative to deform a portion of the other surface means; the method of fixing said gears to said shaft portions including:

pressing said shaft portions partially and simultaneously into said bore surface means to effect at least a partial interference fit between said shaft and bore surface means; and pressing said shaft portions further and simultaneously into said bore surface means to effect deformation of said other surface means by said spline teeth, thereby forming mating splines in said other surface means.

31. The method of claim 30, further including forming said spline teeth operative to deform on said shaft portions.

* * * * *